US009856741B2

(12) United States Patent
Grant et al.

(10) Patent No.: US 9,856,741 B2
(45) Date of Patent: Jan. 2, 2018

(54) POWER TURBINE COOLING AIR METERING RING

(71) Applicant: PW POWER SYSTEMS, INC., Glastonbury, CT (US)

(72) Inventors: Fernando K Grant, South Windsor, CT (US); John J Korzendorfer, Glastonbury, CT (US); Fabian D Betancourt, Meriden, CT (US)

(73) Assignee: PW Power Systems, Inc., Glastonbury, CT (US)

( * ) Notice: Subject to any disclaimer, the term of this patent is extended or adjusted under 35 U.S.C. 154(b) by 435 days.

(21) Appl. No.: 14/512,532

(22) Filed: Oct. 13, 2014

(65) Prior Publication Data

US 2016/0102577 A1 Apr. 14, 2016

(51) Int. Cl.

| | |
|---|---|
| ***F01D 9/04*** | (2006.01) |
| ***F01D 9/06*** | (2006.01) |
| ***F01D 11/00*** | (2006.01) |
| ***F01D 25/12*** | (2006.01) |
| ***F01D 25/16*** | (2006.01) |
| ***F01D 25/24*** | (2006.01) |

(52) U.S. Cl.

CPC ..... *F01D 9/042* (2013.01); *F01D 9/065* (2013.01); *F01D 11/005* (2013.01); *F01D 25/12* (2013.01); *F01D 25/246* (2013.01); *F01D 25/162* (2013.01)

(58) Field of Classification Search

CPC ..... F01D 9/042; F01D 9/065; F01D 11/005; F01D 25/12; F01D 25/125; F01D 25/162; F01D 25/246

See application file for complete search history.

(56) References Cited

U.S. PATENT DOCUMENTS

| | | | | | |
|---|---|---|---|---|---|
| 3,630,633 | A * | 12/1971 | Stockton | F01D 17/162 | 415/10 |
| 4,053,189 | A * | 10/1977 | Novotny | F01D 25/28 | 384/476 |
| 4,321,007 | A * | 3/1982 | Dennison | F01D 25/162 | 415/142 |
| 4,428,713 | A * | 1/1984 | Coplin | F01D 25/08 | 415/116 |
| 4,478,551 | A * | 10/1984 | Honeycutt, Jr. | F01D 25/162 | 415/139 |
| 4,864,810 | A * | 9/1989 | Hines | F01D 3/04 | 415/105 |
| 4,979,872 | A * | 12/1990 | Myers | F01D 9/065 | 403/131 |
| 6,679,045 | B2 * | 1/2004 | Karafillis | F01D 25/16 | 184/6.11 |
| 8,292,580 | B2 * | 10/2012 | Schiavo | F01D 5/189 | 416/229 A |
| 2013/0115057 | A1 * | 5/2013 | Suciu | F01D 25/162 | 415/170.1 |
| 2015/0260057 | A1 * | 9/2015 | Farah | F01D 25/24 | 60/796 |
| 2016/0237854 | A1 * | 8/2016 | Grant | F02C 7/24 | |

* cited by examiner

*Primary Examiner* — Nathaniel Wiehe
*Assistant Examiner* — Brian O Peters
(74) *Attorney, Agent, or Firm* — Schwegman Lundberg & Woessner, P.A.

(57) ABSTRACT

A power turbine section for a gas turbine engine includes a heat shield assembly mounted to a bearing support to form a first annular compartment and a second annular compartment.

21 Claims, 11 Drawing Sheets

POWER TURBINE COOLING AIR METERING RING

BACKGROUND

The present disclosure relates to a gas turbine engine and, more particularly, to a power turbine section therefor.

In a gas turbine engine, such as a large frame heavy-duty industrial gas turbine (IGT) engine, a core gas stream generated in a gas generator section is passed through a power turbine section to produce mechanical work. The power turbine includes one or more rows, or stages, of stator vanes and rotor blades that react with the core gas stream.

Interaction of the core gas stream with the power turbine hardware may result in the hardware being subjected to temperatures beyond the design points. Over time, such temperatures may reduce the life of the power turbine at the junction between the gas generator section and the power turbine section.

SUMMARY

A power turbine section for a gas turbine engine according to one disclosed non-limiting embodiment of the present disclosure includes a heat shield assembly mounted to the bearing support to form a first annular compartment and a second annular compartment.

A further embodiment of the present disclosure includes a metering ring, the metering ring disposed between the first annular compartment and the second annular compartment.

A further embodiment of any of the foregoing embodiments of the present disclosure includes, wherein the metering ring includes a multiple of apertures to communicate cooling flow from the first annular compartment to the second annular compartment.

A further embodiment of any of the foregoing embodiments of the present disclosure includes, wherein the apertures are sized to permit the cooling air to disperse around the first annular compartment before communication to the second annular compartment.

A further embodiment of any of the foregoing embodiments of the present disclosure includes a fitting to communicate cooling airflow into the heat shield assembly.

A further embodiment of any of the foregoing embodiments of the present disclosure includes an air strut in airflow communication with the fitting.

A further embodiment of any of the foregoing embodiments of the present disclosure includes, the air strut comprising more than one passage, at least one of the more than one passage in airflow communication with the heat shield assembly.

A further embodiment of any of the foregoing embodiments of the present disclosure includes, wherein the more than one passage is in airflow communication with a compressor section.

A further embodiment of any of the foregoing embodiments of the present disclosure includes, wherein the bearing support is a #7 bearing support.

A power turbine section for a gas turbine engine according to another disclosed non-limiting embodiment of the present disclosure includes an inlet case along an axis; a power turbine vane array mounted to the inlet case; a bearing support mounted to the power turbine vane array; a heat shield mounted to the bearing support; and a metering ring mounted to the bearing support to form a first annular compartment between the heat shield and the metering ring, and a second annular compartment between the metering ring and the bearing support.

A further embodiment of any of the foregoing embodiments of the present disclosure includes, wherein the metering ring comprising a multiple of apertures to communicate cooling flow from the first annular compartment to the second annular compartment.

A further embodiment of any of the foregoing embodiments of the present disclosure includes, wherein the apertures are sized to permit the cooling air to disperse around the first annular compartment before communication to the second annular compartment.

A further embodiment of any of the foregoing embodiments of the present disclosure includes a fitting to communicate cooling airflow into the heat shield assembly.

A further embodiment of any of the foregoing embodiments of the present disclosure includes an air strut mounted to the inlet case transverse to an inlet duct that defines a core flow path, the air strut including a passage in airflow communication with the fitting.

A further embodiment of any of the foregoing embodiments of the present disclosure includes an air strut mounted to the inlet case transverse to an inlet duct for a core gas path flow, the air strut including a passage in communication with the fitting.

A further embodiment of any of the foregoing embodiments of the present disclosure includes, wherein the bearing support is a #7 bearing support.

A further embodiment of any of the foregoing embodiments of the present disclosure includes, wherein the gas turbine engine is an industrial gas turbine engine within a ground mounted enclosure.

A method of communicating a cooling airflow within a power turbine, according to another disclosed non-limiting embodiment of the present disclosure includes communicating a cooling airflow from a compressor section through an air strut; communicating the cooling flow into a first annular compartment between a heat shield and a metering ring; and communicating the cooling airflow from the first annular compartment through the metering ring into a second annular compartment between the metering ring and a bearing support.

A further embodiment of any of the foregoing embodiments of the present disclosure includes sizing a multiple of apertures in the metering ring to permit the cooling air to disperse around the first annular within the first annular compartment before the communication to the second annular compartment.

A further embodiment of any of the foregoing embodiments of the present disclosure includes communicating the cooling airflow from the second annular compartment to a core flow path through the bearing support subsequent to the communicating the cooing airflow through the metering ring into the second annular compartment.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
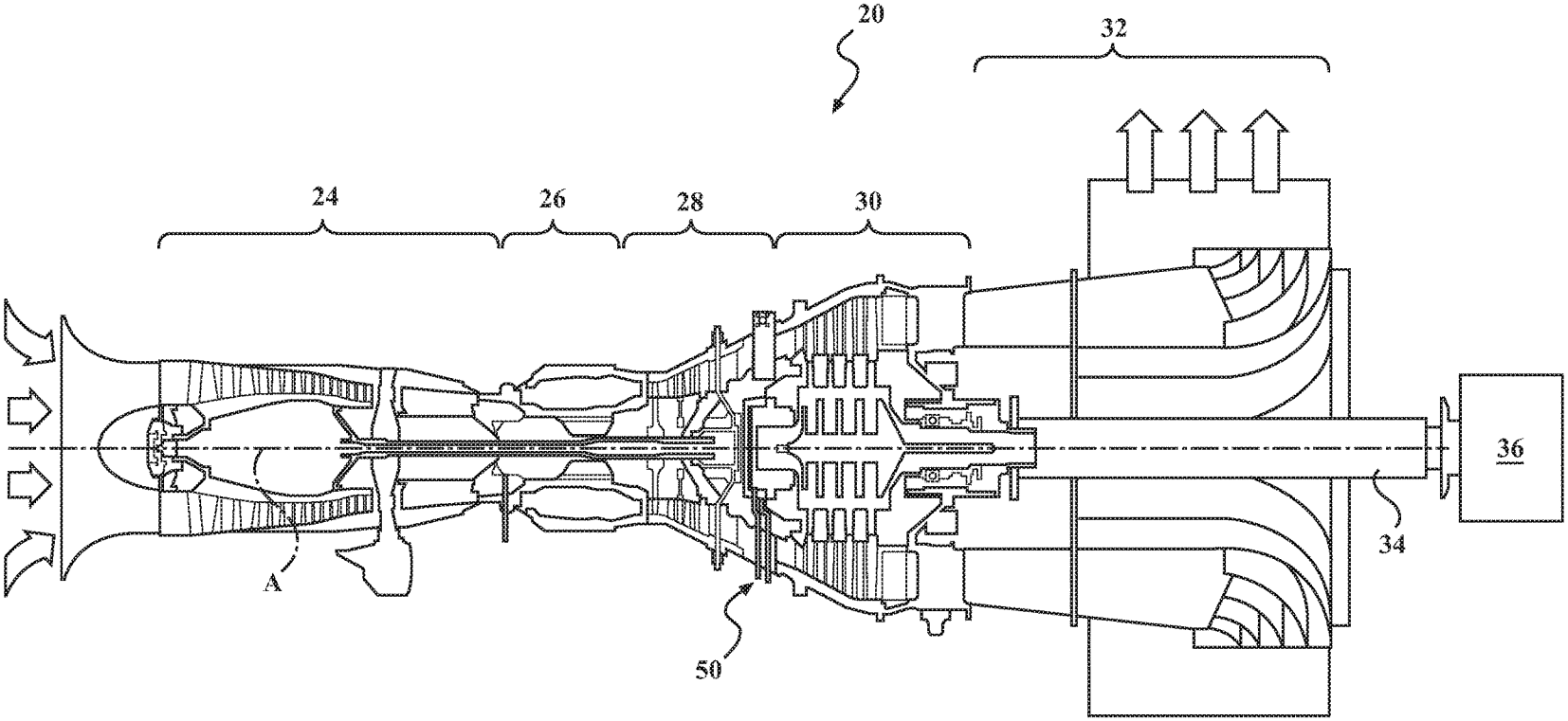
FIG. 1 is a schematic view of an example gas turbine engine architecture.
Figure 2:
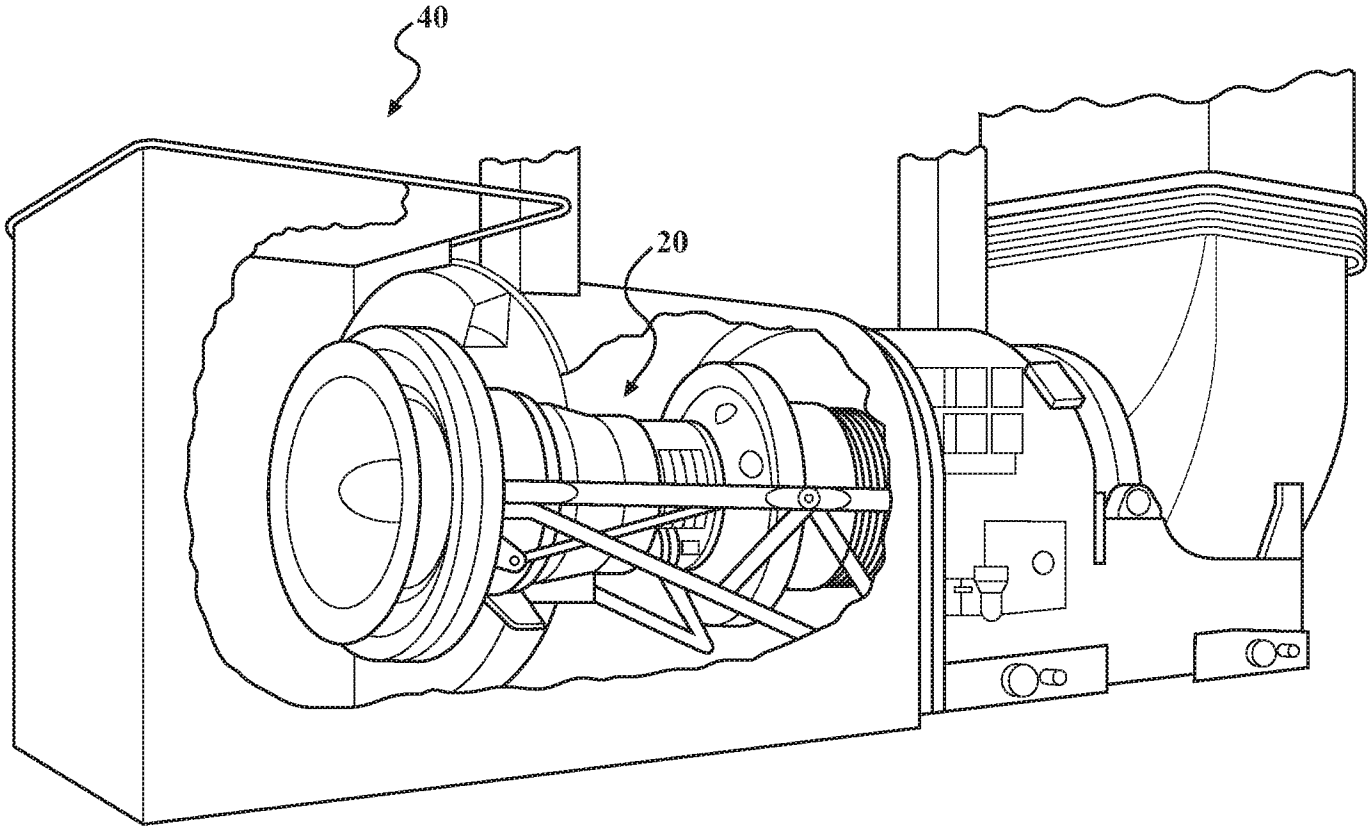
FIG. 2 is a schematic view of an example gas turbine engine in an industrial gas turbine environment.

FIG. 1 schematically illustrates a gas turbine engine 20. The gas turbine engine 20 generally includes a compressor section 24, a combustor section 26, a turbine section 28, a power turbine section 30, and an exhaust section 32. The engine 20 may be situated within a ground mounted enclosure 40 (FIG. 2) typical of an industrial gas turbine (IGT). Although depicted as specific engine architecture in the disclosed non-limiting embodiment, it should be understood that the concepts described herein are not limited to only such architecture as the teachings may be applied to other gas turbine architectures.

Figure 3:
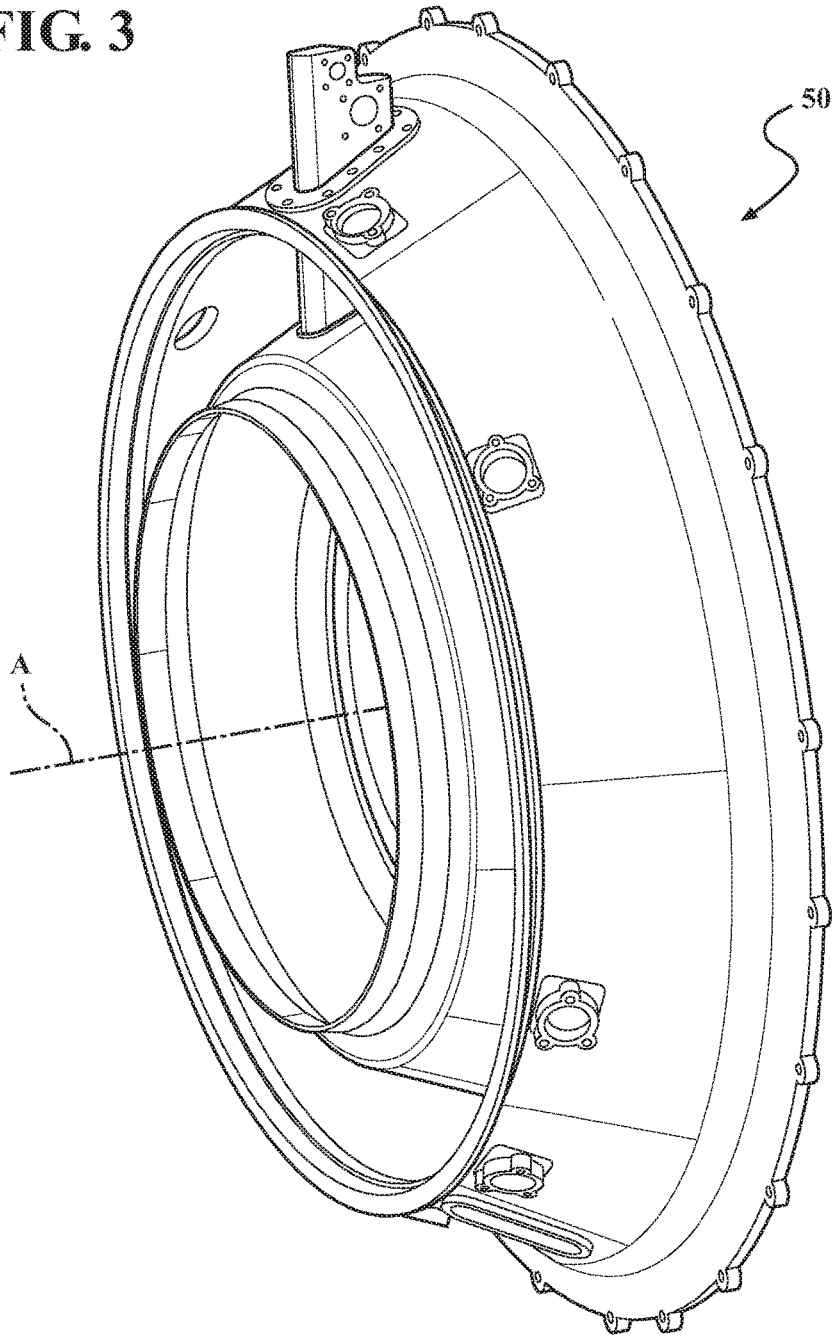
FIG. 3 is a perspective view of a power turbine inlet.

The compressor section 24, the combustor section 26, and the turbine section 28 are commonly referred to as the gas generator section to drive the power turbine section 30. The power turbine section 30 drives an output shaft 34 to power a generator 36 or other system. The power turbine section 30 generally includes a power turbine inlet 50 (FIG. 3) that communicates the core gas stream from the turbine section 28 of the gas generator into the one or more rows, or stages, of stator vanes and rotor blades. In one disclosed non-limiting embodiment, the power turbine section 30 includes a free turbine with no physical connection between the gas generator section and the power turbine section 30. The generated power is a thereby a result of mass flow capture by the otherwise free power turbine.

Figure 4:
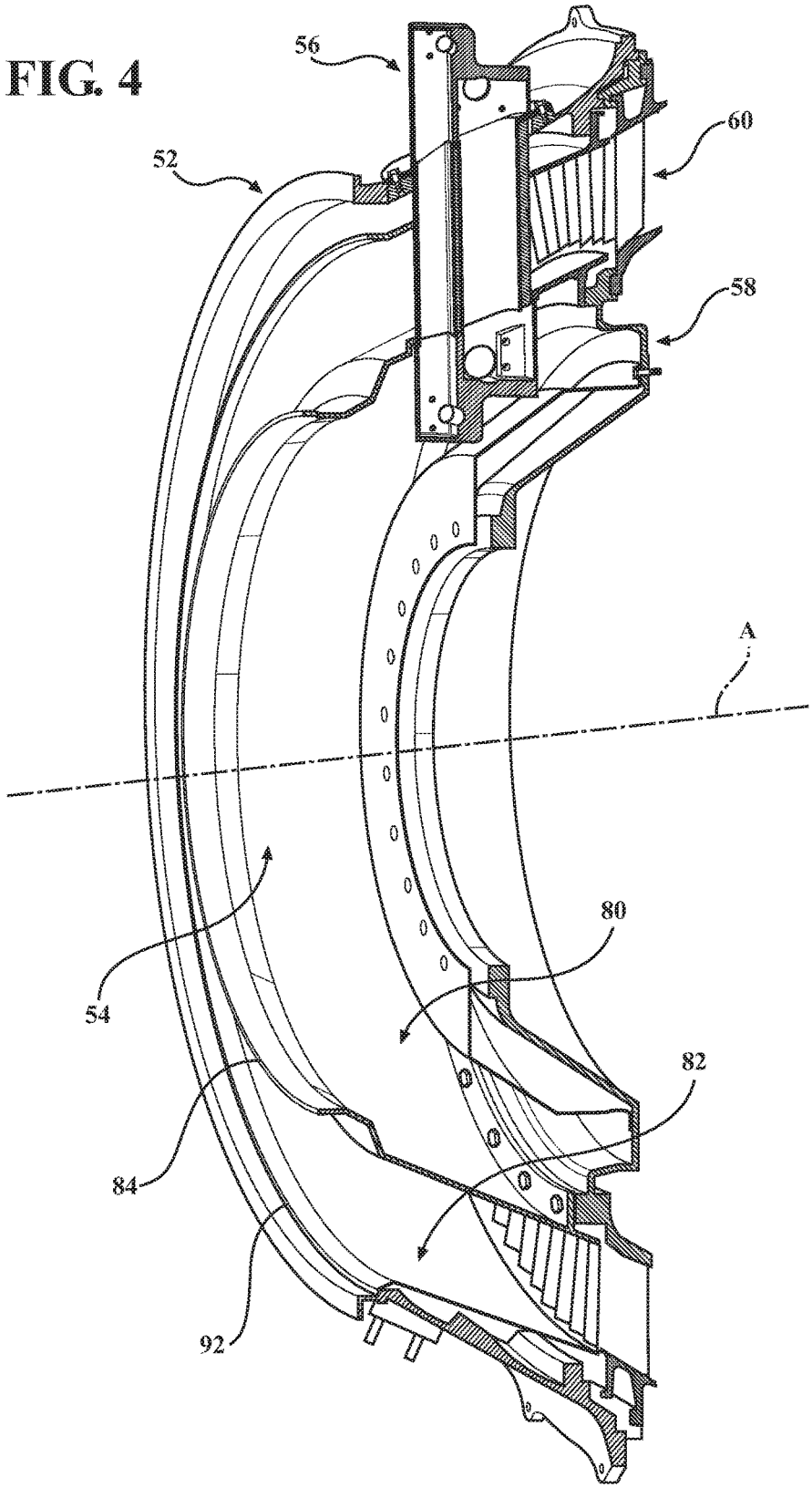
FIG. 4 is a schematic sectional view of power turbine inlet.

With reference to FIG. 4, the power turbine inlet 50 generally includes an inlet case 52, an inlet duct 54, an air strut 56, a bearing support 58, and a first power turbine vane array 60. The inlet duct 54 is mounted to the inlet case 52 and the bearing support 58 to guide the core gas stream to the first power turbine vane array 60 mounted between the inlet case 52 and the bearing support 58. The engine 20 generally includes a multiple of bearing supports 58 to support the rotational hardware for rotation about an engine central longitudinal axis A. In this disclosed non-limiting embodiment, the bearing support 58, in the power turbine inlet 50 is the #7 bearing support in the engine 20.

Figure 5:
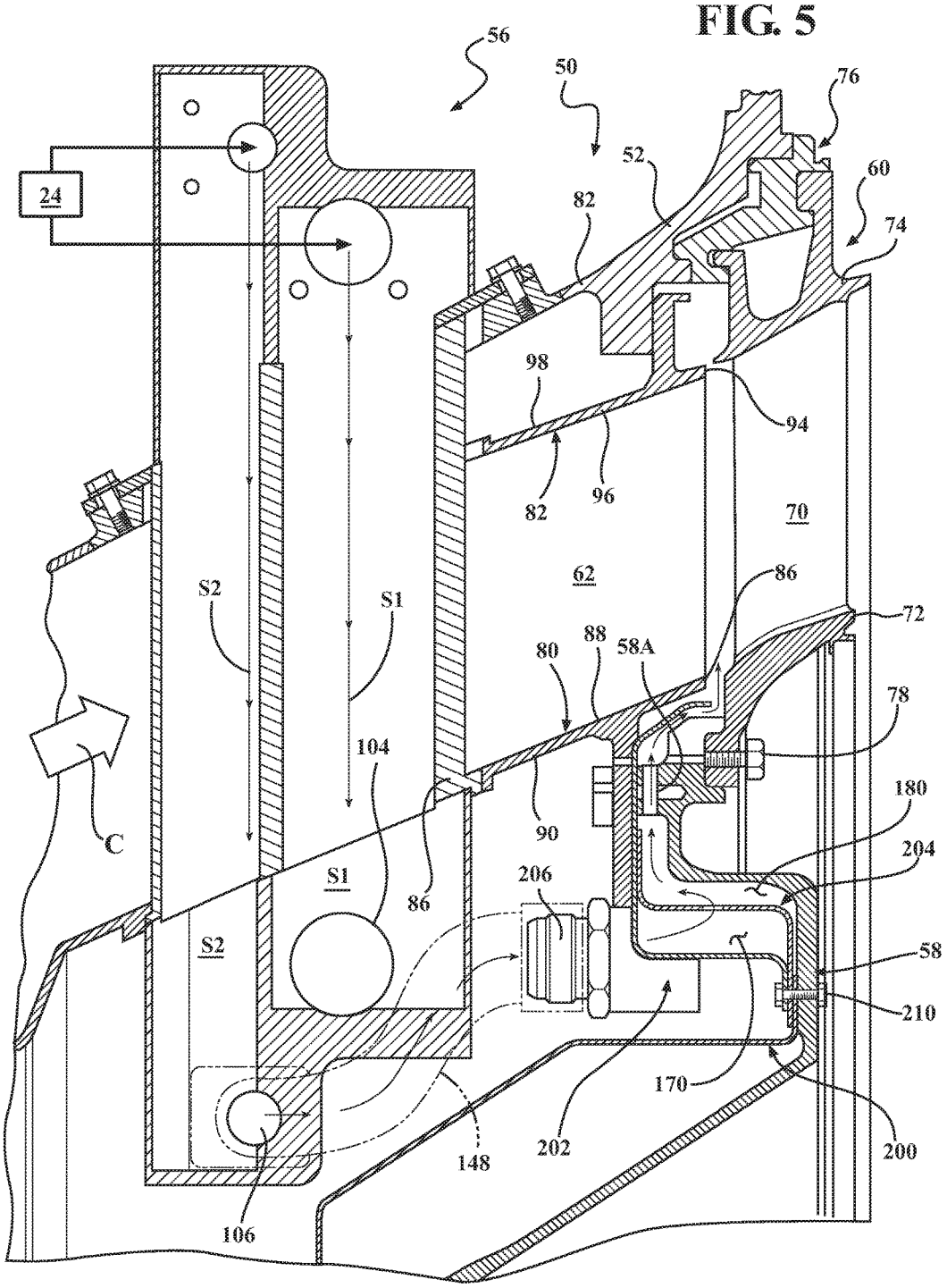
FIG. 5 is an expanded schematic sectional view of the power turbine inlet.

With reference to FIG. 5, the first power turbine vane array 60 generally includes an array of airfoils 70 that extend between a respective inner vane platform 72 and an outer vane platform 74. The outer vane platforms 74 may be mounted to the inlet case 52 via a hook and lug arrangement 76 and the inner vane platform 72 may be mounted to the bearing support 58 via fasteners 78 such as bolts. The respective inner vane platform 72 and the outer vane platform 74 at least partially bound a core gas path flow "C" along a core gas path 62. The air strut 56 communicates secondary cooling airflow "S1" and "S2" from, for example, a multiple of stages in the compressor section 24 to cool hardware in the rotor and bearing compartment of the power turbine 30.

The inlet duct 54 generally includes an annular inner duct wall 80 and an annular outer duct wall 82. The annular inner duct wall 80 includes an upstream edge 84 (shown in FIG. 4), a downstream edge 86, a gas path surface 88, and a non-gas path surface 90. The annular outer wall 82 includes an upstream edge 92 (shown in FIG. 4), a downstream edge 94, a gas path surface 96, and a non-gas path surface 98. The upstream edges 84, 92 are radially inboard of the downstream edges 86, 94 such that the inlet duct 54 generally forms a frustoconical shape (best seen in FIGS. 3 and 4).

The air strut 56 extends through the inlet duct 54 aft of the upstream edges 84, 92 with respect to the airflow direction, and forward of the downstream edges 86, 94. The downstream edges 86, 94 are upstream of the respective inner vane platform 72 and the outer vane platform 74. The annular inner duct wall 80 and the annular outer duct wall 82 are spaced to generally correspond with the span of the airfoils 70.

Figure 6:
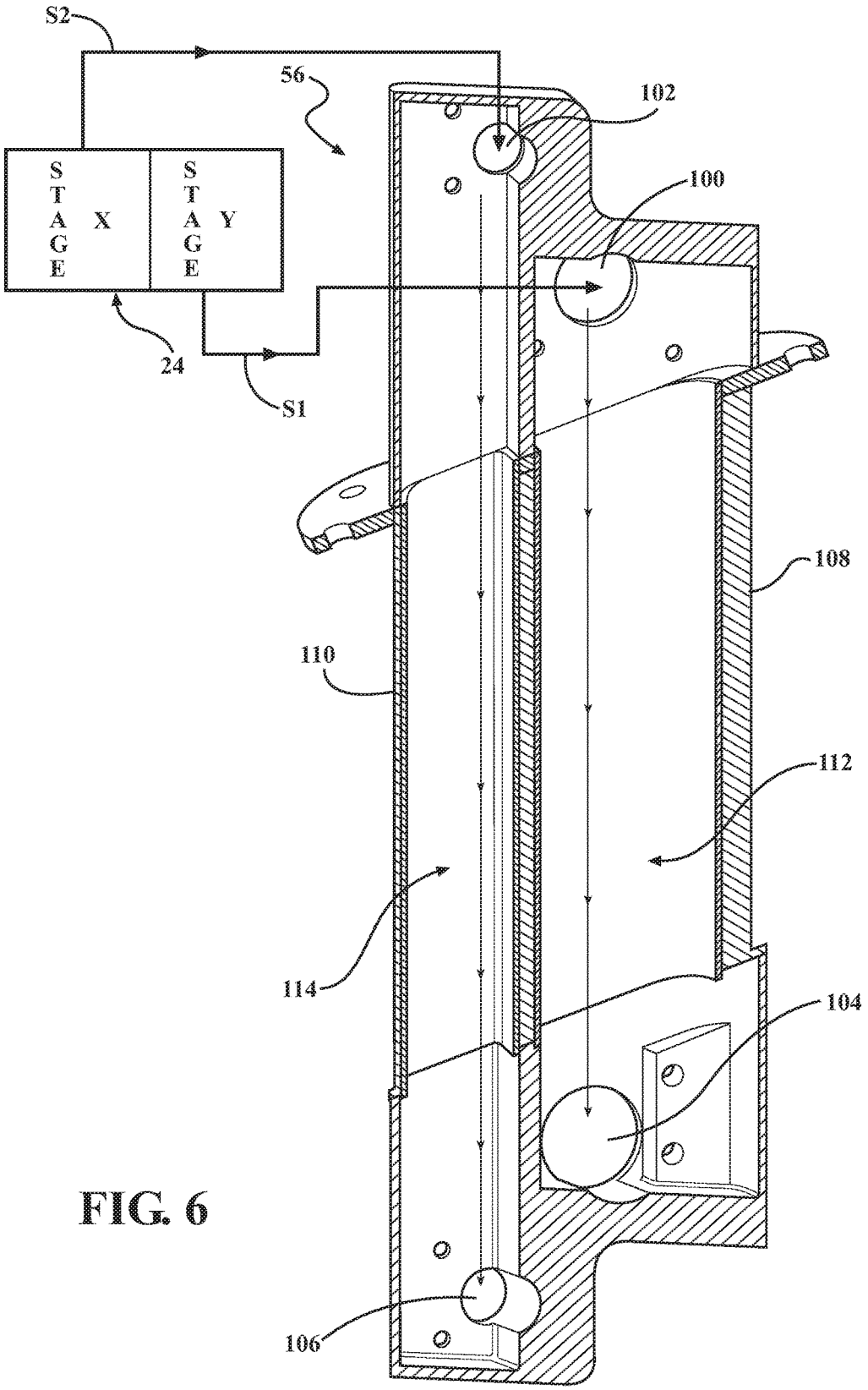
FIG. 6 is an expanded schematic sectional view of an air strut in the power turbine inlet.

With reference to FIG. 6, the air strut 56 generally includes a first inlet 100, a second inlet 102, a first outlet 104, a second outlet 106 and a respective passage 108, 110 therebetween within the air strut 56, to form a respective first passage 112 through the air strut 56 and a second passage 114 through the air strut 56, thereby defining a multiple passage air strut 56. The multiple passage air strut 56 communicates fluid from multiple sources, such as from different stages of the compressor 24, with varied temperatures and pressures into desired locations of the power turbine 30. The passages 112, 114 are sized to balance pressures and temperatures from the selected sources without impact to the upstream sources, i.e., back pressure, restricted flow etc.

Figure 7:
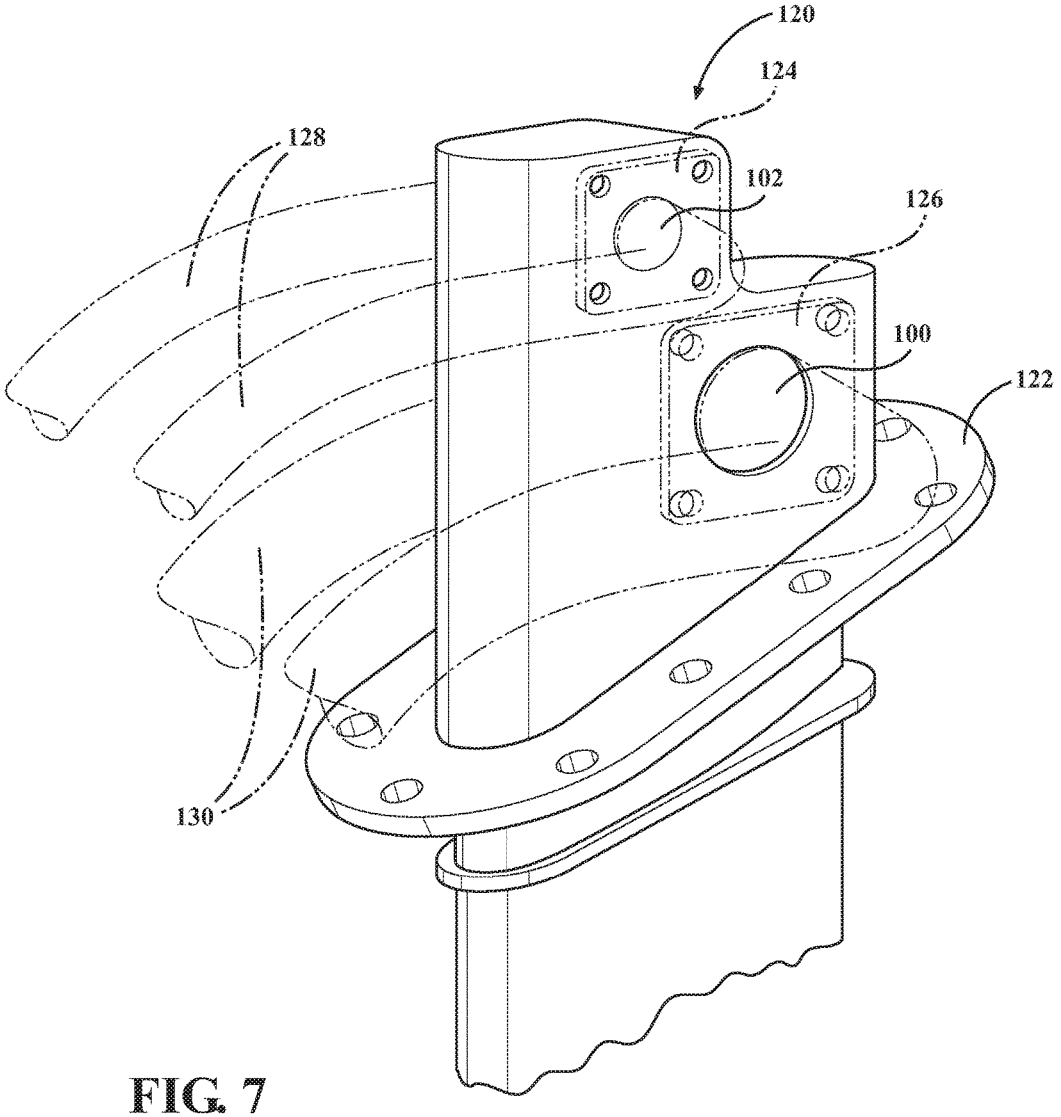
FIG. 7 is a perspective view of an inlet to the air strut.
Figure 8:
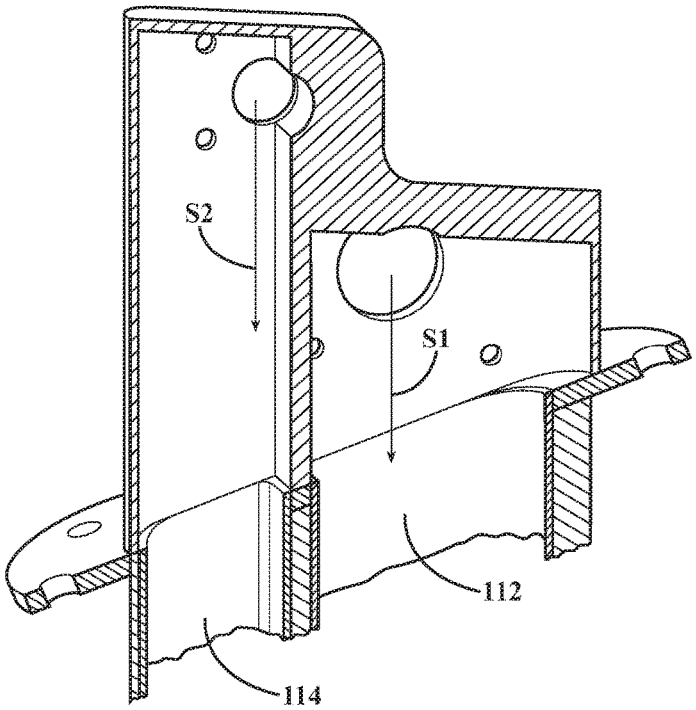
FIG. 8 is an expanded schematic sectional view of the inlet of FIG. 7.

With reference to FIG. 7, the first inlet 100 and the second inlet 102 are located within a stepped area 120 that extends beyond a flange 122 that attaches the air strut 56 to the inlet case 52. The stepped area 120 facilitates attachment of a respective inlet flange 124, 126 of an airflow communication conduit 128, 130 to provide airflow into passages 112, 114. The first inlet 100 communicates airflow "S1" into the first passage 112 and the second inlet 102 communicates airflow "S2" into the passage 114 (FIG. 8).

Figure 9:
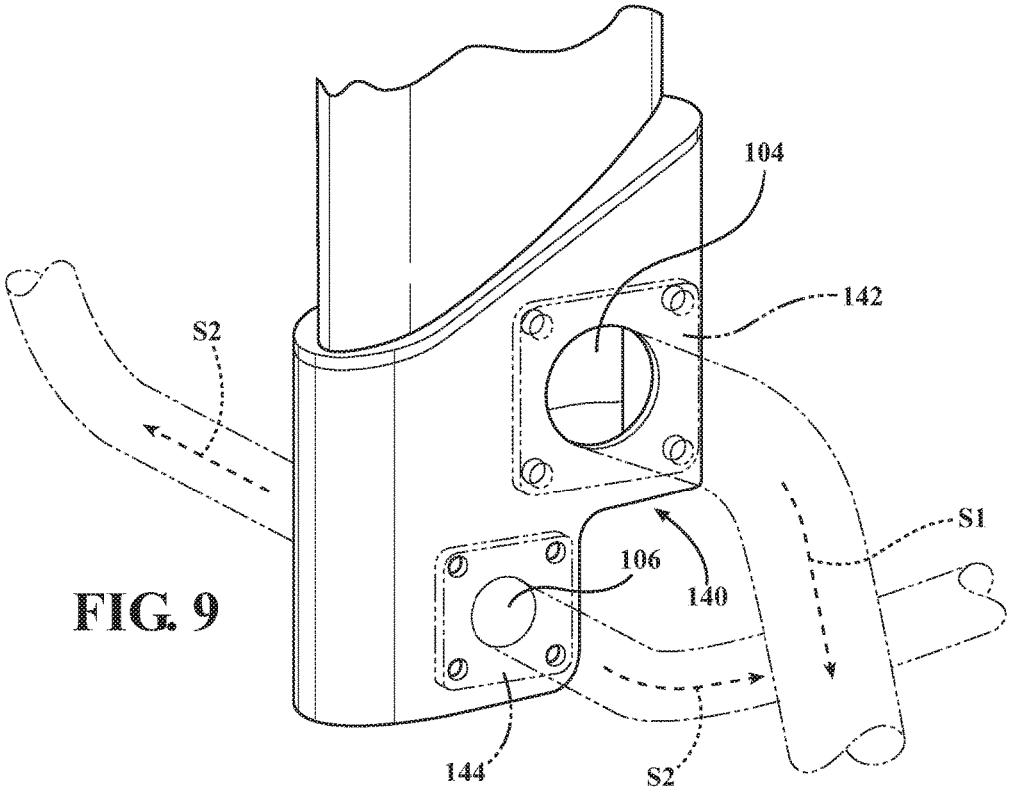
FIG. 9 is a perspective view of an outlet from the air strut.
Figure 10:
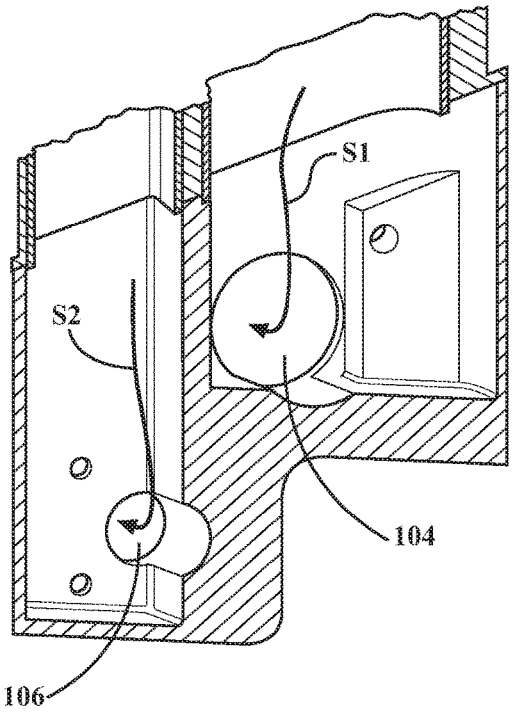
FIG. 10 is an expanded sectional view of the outlet of FIG. 9.
Figure 11:
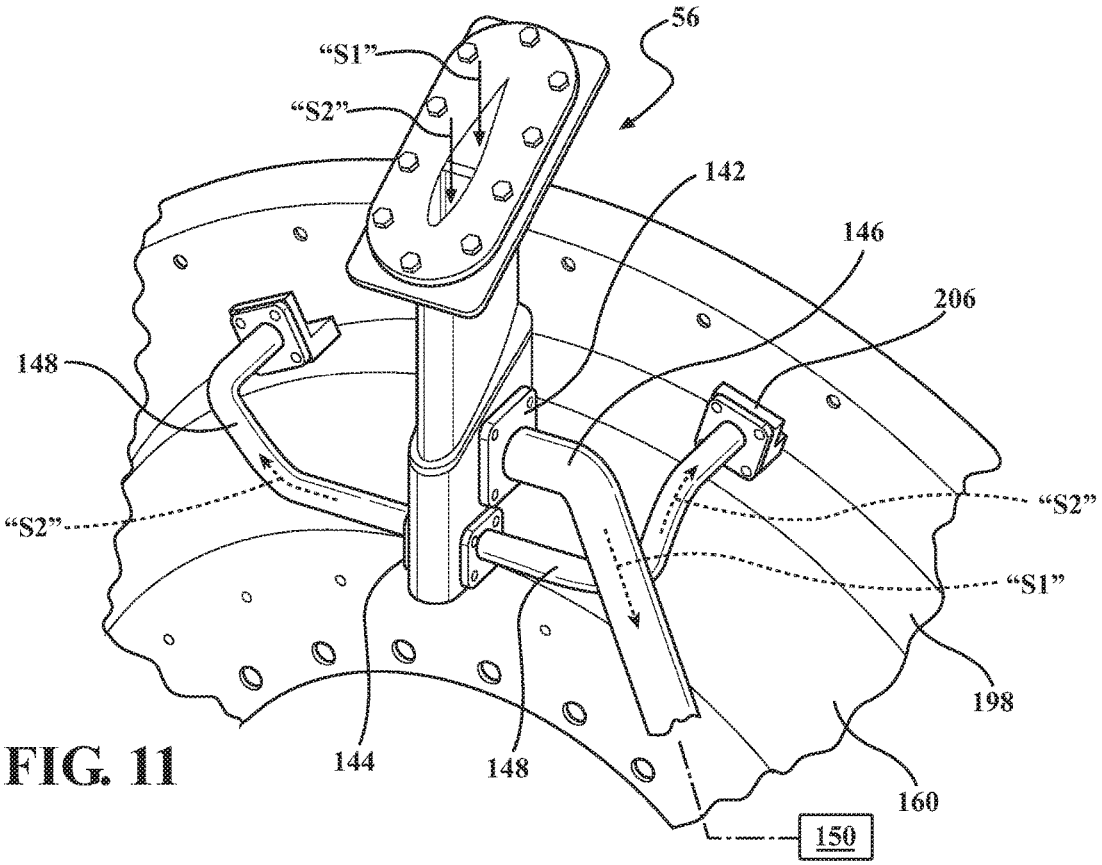
FIG. 11 is a perspective view of the outlet communication paths to the power turbine.

With reference to FIG. 9, the first outlet 104 and the second outlet 106 communicate the separate airflows "S1", "S2" from passages 112, 114 (FIGS. 8 and 10) to separate locations within the power turbine 30 (FIG. 11). A stepped area 140 facilitates attachment of a respective outlet flange 142, 144 of an airflow communication conduit 146, 148 for communication from passages 112, 114.

Figure 12:
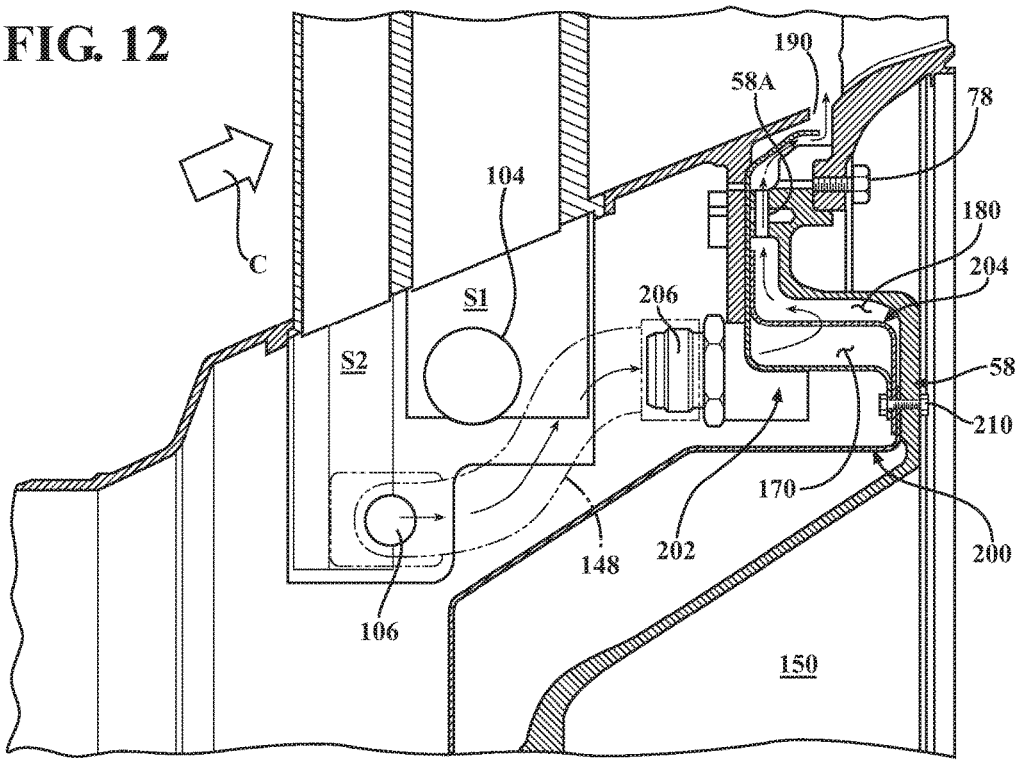
FIG. 12 is a sectional view of the annular compartments from a heat shield assembly.
Figure 13:
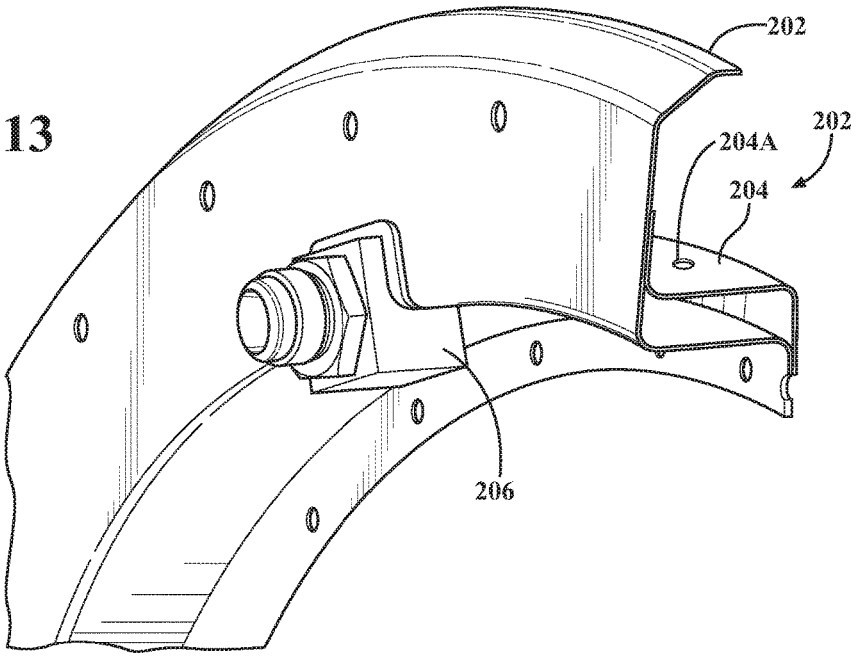
FIG. 13 is a sectional view of the heat shield assembly.

With reference to FIG. 12, a heat shield assembly 200 at least partially thermally protects the bearing support 58. The heat shield assembly 200 generally includes a heat shield 202, a metering ring 204, and a multiple of fittings 206 (also shown in FIG. 13). The heat shield assembly 200 is mounted to the bearing support 58 via fasteners 210.

The first passage 112, in one disclosed, non-limiting embodiment, routes the airstream of airflow "S1" via conduit 146 as is best shown in FIG. 11, to compartment 150 within the bearing support 58 through the heat shield assembly 200. The second passage 114 routes the airstream of airflow "S2" via conduit 148, as is best shown in FIG. 11, to the multiple of fittings 206, thence to a first annular compartment 170 between the heat shield 202 and the metering ring 204.

Figure 14:
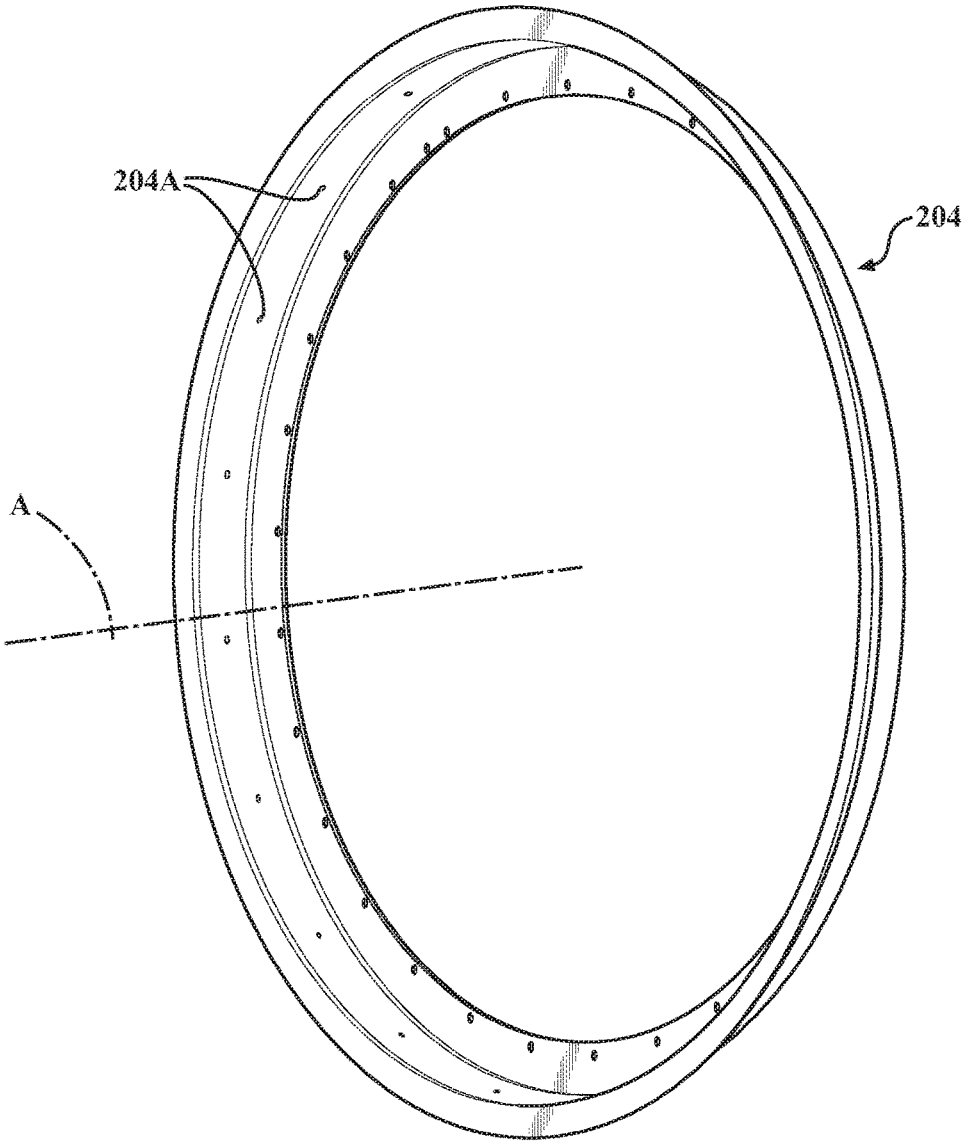
FIG. 14 is a perspective view of a metering ring of the heat shield assembly.

As there are packaging limitations to the number of fittings 206 (one shown) that are readily installed in the heat shield 202 adjacent to the air strut 56, the metering ring 204 provides for a relatively more uniform circulation of the cooling airflow "S2" into a second annular compartment 180 adjacent the bearing support 58. The metering ring 204 includes apertures 204A (FIG. 14) to communicate the cooling air from the first annular compartment 170 to second annular compartment 180. The compartment 180 communicates with the core gas path flow "C" within the core gas path 62 through apertures 58A in the bearing support 58 to communicate cooling airflow and increase the pressure within the compartment 180 via airflow S2 to minimize ingestion of the hot core gas path flow "C".

The metering ring apertures 204A are sized to permit the cooling air to fully circulate within compartment 170 before communication to compartment 180. That is, the cooling air is dispersed around the compartment 170 due to pressure differentials such that the metering ring 204 readily controls escape of cooling air before fully circulating through compartments 170 and 180. Such circulation facilitates effective purge of core gas path flow "C" from compartment 190.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed:

1. A power turbine section for a gas turbine engine comprising:
   - a bearing support having a first end with an aperture therethrough, the bearing support coupled to a power turbine vane array within the power turbine section at the first end; and
   - a heat shield assembly directly mounted to said bearing support, the heat shield assembly including a heat shield and a metering ring, wherein the heat shield and the metering ring completely bound a first annular compartment and the heat shield, metering ring and bearing support bound a second annular compartment;
   - wherein the heat shield includes an aperture in fluid communication with said aperture in the bearing support at the first end.

2. The power turbine section as recited in claim 1, further comprising a metering ring, wherein said metering ring is disposed between said first annular compartment and said second annular compartment.

3. The power turbine section as recited in claim 2, wherein said metering ring includes a multiple of apertures to communicate cooling flow from said first annular compartment to said second annular compartment.

4. The power turbine section as recited in claim 3, wherein said apertures are sized to permit the cooling flow to disperse around said first annular compartment before communication to said second annular compartment.

5. The power turbine section as recited in claim 1, further comprising a fitting to communicate cooling airflow into said aperture of said heat shield.

6. The power turbine section as recited in claim 5, further comprising an air strut in airflow communication with said fitting.

7. The power turbine section as recited in claim 6, wherein said air strut comprises more than one passage, at least one of said more than one passage in airflow communication with said heat shield assembly.

8. The power turbine section as recited in claim 7, wherein said more than one passage is in airflow communication with a compressor section.

9. The power turbine section as recited in claim 8, wherein said bearing support is a #7 bearing support.

10. The power turbine section as recited in claim 1, wherein the first annular compartment and the second annular compartment extend longitudinally across at least a portion of a longitudinal length of the bearing support.

11. A power turbine section for a gas turbine engine comprising:
   - an inlet case along an axis;
   - a power turbine vane array mounted to said inlet case;
   - a bearing support mounted to said power turbine vane array at a first coupling;
   - a heat shield mounted to said bearing support at a second coupling proximate a first end of the heat shield and extending radially outward toward the first coupling at a second end of the heat shield; and a metering ring mounted to said bearing support to form a first annular compartment completely bounded by said heat shield and said metering ring, and a second annular compartment between said metering ring and said bearing support.

12. The power turbine section as recited in claim 11, wherein said metering ring comprises a multiple of apertures to communicate cooling flow from said first annular compartment to said second annular compartment.

13. The power turbine section as recited in claim 12, wherein said apertures are sized to permit the cooling flow to disperse around said first annular compartment before communication to said second annular compartment.

14. The power turbine section as recited in claim 11, further comprising a fitting to communicate cooling airflow into said heat shield assembly.

15. The power turbine section as recited in claim 14, further comprising an air strut mounted to said inlet case transverse to an inlet duct that defines a core flow path, said air strut including a passage in airflow communication with said fitting.

16. The power turbine section as recited in claim 11, wherein said bearing support is a #7 bearing support.

17. The power turbine section as recited in claim 16, wherein said gas turbine engine is an industrial gas turbine engine within a ground mounted enclosure.

18. The power turbine section as recited in claim 11, wherein the metering ring is mounted to said bearing support at the second coupling.

19. A method of communicating a cooling airflow within a power turbine, comprising:

communicating the cooling airflow from a compressor section through an air strut that extends through an inlet case and an inlet duct;

communicating the cooling airflow into a first annular compartment between a heat shield and a metering ring that are both mounted to a stationary bearing support; and communicating the cooling airflow from the first annular compartment through the metering ring into a second annular compartment between the metering ring and the bearing support;

wherein the cooling airflow is communicated radially outward through the first annular compartment and the second annular compartment.

20. The method as recited in claim 19, further comprising sizing a multiple of apertures in the metering ring to permit the cooling air to disperse within the first annular compartment before the communication to the second annular compartment.

21. The method as recited in claim 20, further comprising communicating the cooling airflow from the second annular compartment to a core flow path through the bearing support subsequent to the communicating the cooing airflow through the metering ring into the second annular compartment.

* * * * *